US005613829A

United States Patent [19]

Wolfe et al.

[11] Patent Number: 5,613,829

[45] Date of Patent: Mar. 25, 1997

[54] GAS TURBINE SUBASSEMBLY HAVING A BRUSH SEAL

[75] Inventors: Christopher E. Wolfe, Niskayuna, N.Y.; Osman S. Dinc, Istanbul, Turkey

[73] Assignee: General Electric Company, Schenectady, N.Y.

[21] Appl. No.: 642,289

[22] Filed: May 3, 1996

[51] Int. Cl.[6] ..... F04D 29/08

[52] U.S. Cl. ..... 415/174.1; 415/174.2; 415/170.1

[58] Field of Search ..... 415/134, 135, 415/136, 137, 138, 139, 170.1, 174.1, 174.2, 229, 230, 231

[56] References Cited

U.S. PATENT DOCUMENTS

| | | | |
|---|---|---|---|
| 4,415,309 | 11/1983 | Atterbury | 415/174.2 |
| 5,074,748 | 12/1991 | Hagle | 415/170.1 |
| 5,181,728 | 1/1993 | Stec | 415/174.2 |
| 5,265,412 | 11/1993 | Bagepalli et al. | 415/134 |
| 5,400,586 | 3/1995 | Bagepalli et al. | 415/134 |
| 5,474,306 | 12/1995 | Bagepalli et al. | 415/174.2 |
| 5,480,162 | 1/1996 | Beeman, Jr. | 415/174.2 |

OTHER PUBLICATIONS

U.S. Patent Application Ser. No. 08/425,009, filed Apr. 17, 1995, by Bharat Bagepalli et al., entitled "Brush Seal for a Gas Turbine".

U.S. Patent Application Ser. No. 08/425,008, filed Apr. 17, 1995, by Bharat Bagepalli et al., entitled "Method for Making a Brush Seal".

*Primary Examiner*—John T. Kwon

*Attorney, Agent, or Firm*—Douglas E. Erickson; Marvin Snyder

[57] ABSTRACT

A gas turbine subassembly having a stator, a rotor, and an annular brush seal which is attached to the stator and whose free end is in line-to-line contact with a first circumferential portion of the rotor's outside surface during a first rotation/load state (such as a full-speed/full-load state of a power-plant gas-turbine rotor). A longitudinally-adjoining second circumferential portion (such as a groove) has a smaller diameter than that of the first circumferential portion. The rotor and stator together undergo a predetermined differential thermal movement when the rotor transitions to a second rotation/load state (such as a turning-gear/no-load state). During such movement, the free end of the brush seal moves radially inward and longitudinally across the second portion, preferably without any contact, to minimize or eliminate brush seal wear.

10 Claims, 4 Drawing Sheets

GAS TURBINE SUBASSEMBLY HAVING A BRUSH SEAL

BACKGROUND OF THE INVENTION

The present invention relates generally to gas turbines, and more particularly to a gas turbine subassembly having a brush seal.

Gas turbines include combustion-type gas turbines, which utilize combustion gases to turn rotors, and steam-type gas turbines, which utilize steam to turn rotors. Examples of gas turbines include, but are not limited to, gas-turbine power-generation equipment and gas-turbine aircraft engines. A combustion-type gas turbine has a gas path which typically includes, in serial-flow relationship, an air intake (or inlet), a compressor, a combustor, a turbine, and a gas outlet (or exhaust nozzle). A steam-type gas turbine has a gas path which typically includes a steam inlet, a turbine, arid a steam outlet.

Compressors and turbines include rotating rotors rotatably attached to surrounding non-rotating stator by suitable bearings. Gas paths between compressors and combustor and between combustor and turbines include annular transition ducts having radially inner and outer stator portions. At certain axial locations, rotors typically include radially-outwardly projecting rotor blades, and at certain axial locations, stator typically include radially-inwardly projecting stator vanes. Some gas turbines include high and low pressure compressors and high and low pressure turbines with the high pressure compressor rotor surrounding the low pressure compressor rotor and with the high pressure turbine rotor surrounding the low pressure turbine rotor.

Gas leakage between certain gas-turbine components is undesirable because it wastes gas (e.g., air, combustion gas, steam, etc.) Causing a loss in power and efficiency. For example, such loss in power and efficiency occurs due to gas leakage between the radially-overlapping portions of the compressor rotor and the radially inner stator of the associated annular duct which directs gas downstream towards the combustor. Also, such loss in power and efficiency occurs due to gas leakage past a rotor/stator or rotor/rotor bearing with additional problems including overheating of the bearing causing excessive oil use.

Conventional gas-turbine power-generation equipment includes a gas turbine having a honeycomb-labyrinth seal whose labyrinth hard teeth are attached to the radially-underlapping portion of the compressor and whose honeycomb segment is attached to the radially-overlapping portion of the inner stator of the associated annular duct which directs gas downstream towards the combustor. It is known that the labyrinth hard teeth will abrade away a portion of the honeycomb segment due to differertial thermal movement during shutdown.

Conventional gas turbine aircraft engines include gas turbines which have used annular brush seals between stator and rotors. Although a brush seal affords better sealing than any labyrinth seal (including a honeycomb-labyrinth seal), the free ends of such seals became damaged and worn during engine operation. One known cause is damaging contact caused by aircraft engine vibration. Another known cause is contact-wear caused by differential thermal movement when the engine transitions between two different operating states.

What is needed is a gas turbine subassembly which has a brush seal and which reduces or eliminates brush seal wear.

SUMMARY OF THE INVENTION

It is an object of the invention to provide a gas turbine subassembly having a brush seal.

In a first preferred embodiment, the gas turbine subassembly of the invention includes a gas-turbine stator, a gas-turbine rotor, and a generally annular brush seal. The rotor has generally-steady-state first and second rotation/load states (such as a full-speed/full-load state and a turning-gear/no-load state for a power-plant gas-turbine rotor). The rotor is generally coaxially aligned with and positioned radially within and radially apart from the stator. The rotor includes an outside surface with longitudinally-extending and longitudinally-adjoining first and second circumferential portions. The first circumferential portion has a manufactured first diameter which is generally constant over the longitudinal extent of the first circumferential portion. The second circumferential portion (which may be a groove) has a manufactured second diameter which is everywhere smaller than the first diameter over the longitudinal extent of the second circumferential portion. The rotor and stator together undergo a predetermined differential radial and longitudinal thermal movement when the rotor undergoes a transition from the first rotation/load state to the second rotation/load state. The brush seal is generally coaxially aligned with the stator and has an attached end and a free end. The attached end is attached to the stator, and the free end extends inward of the stator. The free end is located in general line-to-line contact with the first circumferential portion when the gas-turbine rotor is in the first rotation/load state, and the predetermined differential radial and longitudinal thermal movement includes the free end moving radially inward and longitudinally across the second circumferential portion.

A second preferred embodiment is identical to the first preferred embodiment, but the attached end of the brush seal is attached to the rotor, the free end extends outward of the rotor, the stator has an inside surface with its first circumferential portion having a first diameter which is generally constant over the longitudinal extent of the first circumferential portion and with its second circumferential portion having a second diameter which is everywhere larger than the first diameter over the longitudinal extent of the second circumferential portion, and the thermal movement includes the free end moving radially outward and longitudinally across the second circumferential portion.

A third preferred embodiment is identical to the first preferred embodiment but with the stator replaced with another rotor.

A fourth preferred embodiment is identical to the second preferred embodiment but with the stator replaced with another rotor.

Several benefits and advantages are derived from the invention. Brush seals are highly efficient seals but are subject to contact-wear which severely degrades their sealing efficiency. In the first preferred embodiment, the gas-turbine subassembly of the invention includes a brush seal which is attached to the stator and which makes general line-to-line contact (for high seal efficiency) with the first circumferential portion of the outside surface of the gas-turbine rotor when such rotor is in the first rotation/load state (such as a full-speed/full-load state for a power-plant gas-turbine rotor). The second circumferential portion (which may be a groove) has a diameter which is everywhere smaller than t he diameter of the first circumferential portion so that the brush seal has less (or preferably no) contact-wear due to the predetermined differential thermal movement (e.g., the brush seal's free-end moves into the groove without contacting the gas-turbine rotor) during the transition to the second rotation/load state (such as a turning-gear/no-load state).

BRIEF DESCRIPTION OF THE DRAWINGS

The accompanying drawings illustrate several preferred embodiments of the present invention wherein.

DETAILED DERSCRIPTION OF THE INVENTION

Figure 1:
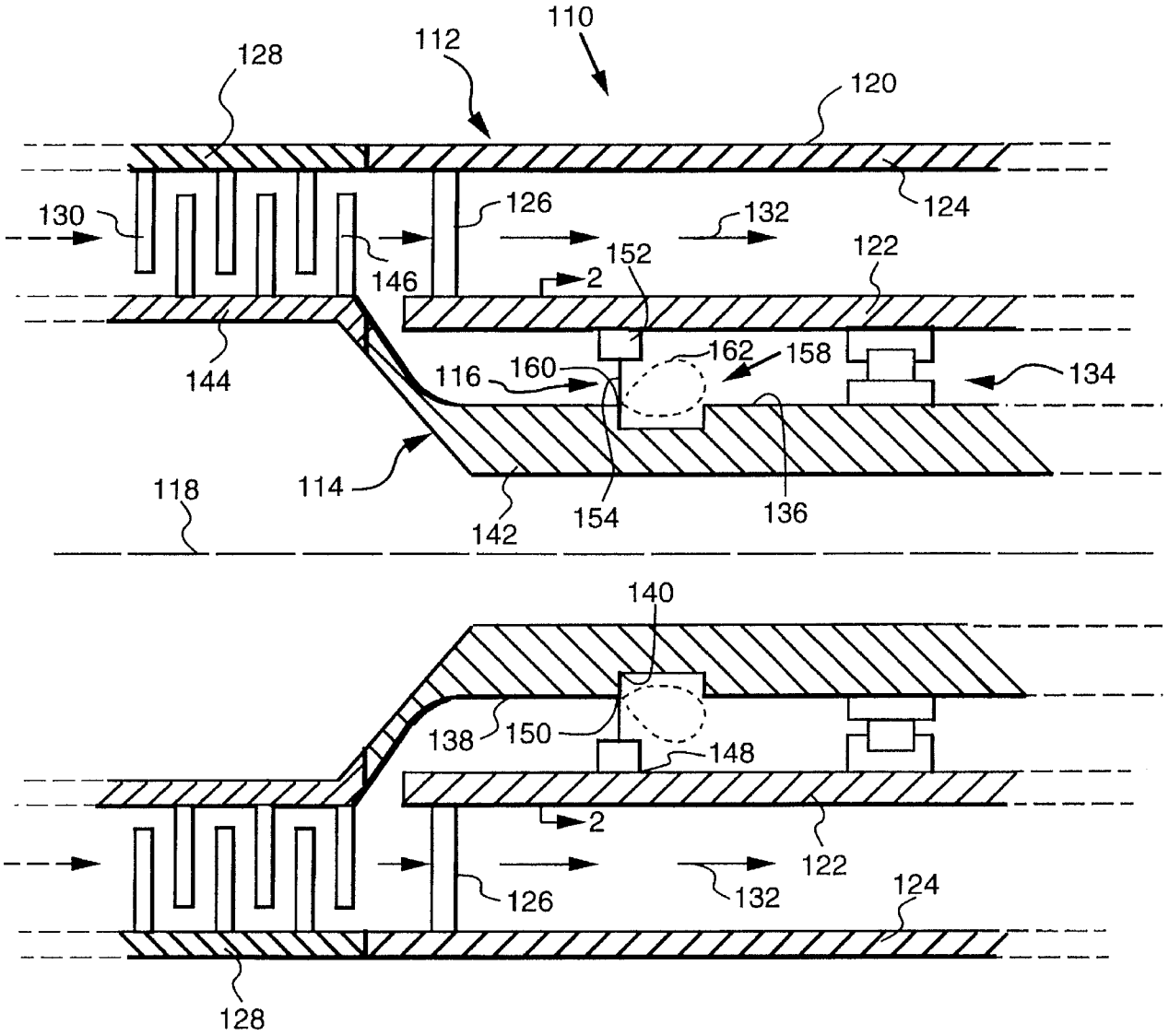
FIG. 1 is a schematic cross-sectional side-elevational larger-area view a first preferred embodiment of the gas-turbine subassembly of the present invention including a stator, a rotor, and a brush seal attached to the stator.
Figure 2:
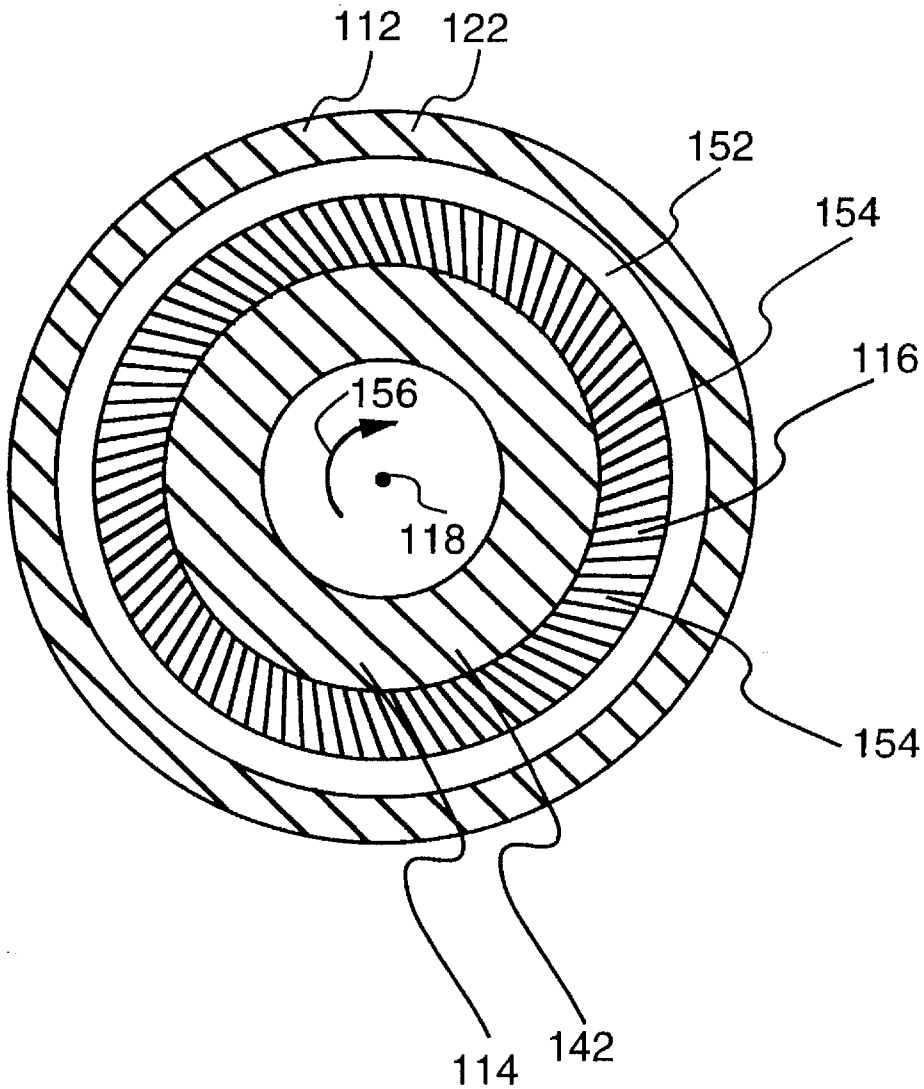
FIG. 2 is a schematic cross-sectional view of the subassembly of FIG. 1 taken along lines 2—2 in FIG. 1.

Referring now to the drawings, wherein like numerals represent like elements throughout, FIGS. 1 and 2 schematically show a first preferred embodiment of the gas turbine subassembly 110 of the present invention. The gas turbine subassembly 110 includes a gas-turbine stator 112, a gas-turbine rotor 114, and a generaily annular brush seal 116. The gas turbine subassembly 110 isi a subassembly of a complete gas turbine (not shown) such as a cbmbustion-type gas turbine which utilizes combustion gases to turn the gas-turbine rotor 114 or a steam-type gas turbine which utilizes steam to turn the gas-turbine rotor 114. Gas turbine are used to power aircraft, ships, tanks, pipeline pumps, electric generators, etc. For purposes of illustration, and not limitation, the gas turbine subassembly 110 of the present invention will be described with particular reference to a power-plant gas turbine.

The gas-turbine stator 112 has a generally longitudinally extending axis 118. In a first preferred construction, the gas-turbine stator 112 includes an annular transition duct 120 having radially inner and outer stator portions 122 and 124 and a circumfrential row of outlet guide vanes 126 (only two of which are sh own in FIG. 1) whose radially inner ends are attached to the radially inner stator portion 122 and whose radially outer ends are attached to the radially outer stator portion 124. The gas-turbine stator 112 preferably further includes a compressor stator casing 128 attached to the radially outer stator portion 124 of the transition duct 120 and three circumferential rows of compressor stator vanes 130 depending radially inward from the compressor stator casing 128. The direction of gas flow (in this case air flow), as indicated by arrows 132, in the gas path of the gas turbine is from the compressor through the transition duct 120 to the combustor (not shown).

The gas-turbine rotor has generally-steady-state first and second rotation/load state. Preferably, the gas-turbine rotor 114 is a power-plant gas-turbine rotor, the first rotation/load state is a full-speed/full-load state, and the second rotation/load state is a turning-gear/no-load state. The full-speed/full-load state is self explanatory. The turning-gear/no-load state describes a gas-turbine rotor 114 which is being rotated at a low idle speed by an auxiliary motor through a turning gear. Gas-turbine rotors used in ships, aircraft, etc., have their own various steady-state rotation/load states, as is known to the artisan. The gas-turbine rotor 114 and the gas-turbine stator 112 together undergo a predetermined differential radial and longitudinal thermal movement when the gas-turbine rotor 114 undergoes a transition from the first rotation/load state to the second rotation/load state. Such differential movement can be calculated (or measured) for a perticular gas turbine, as can be done by those of ordinary skill in the art.

The gas-turbine rotor 114 is generally coaxially aligned with and disposed radially within and radially apart from the gas-turbine stator 112. The gas-turbine rotor 114 is rotatably attached to the gas-turbine stator 112 typically by rolling element bearings 134 (only one of which is shown in FIG. 1). The gas-turbine rotor 114 includes an outside surface 136 with longitudinally-extending and longitudinally-adjoining first and second circumferential portions 138 and 140. The first circumferential portion 138 has a manufactured first diameter which is generally constant over the longitudinal extent of the first circumferential portion 138. The second circumferential portion 140 has a manufactured second diameter which is everywhere smaller than the first diameter over the longitudinal extent of the second circumferential portion 140. Preferably, the second circumferential portion 140 has a form of a groove in the outside surface 136 of the gas-turbine rotor 114. The second diameter may vary over the longitudinal extent of the groove. In other constructions, the gas-turbine rotor may consist of a stepped-up first circumferential portion and a stepped-down second circumferential portion, or the gas-turbine rotor's first circumferential portion may simply be a raised ridge on the rotor. In a first preferred construction, the gas turbine rotor 114 has a transition rotor segment 142 associated with the transition duct 120, a compressor rotor segment 144 attached to the transition rotor segment 142, and three circumferential rows of compressor rotor blades 146 extending radially outward from the compressor rotor segment 144.

The generally annular brush seal 116 is generally coaxially aligned with the gas-turbine stator 112. The brush seal 116 has an attached end 148 and a free end 150. The attached end 148 of the brush seal 116 is attached (directly or indirectly) to the gas-turbine stator 112, and the free end 150 of the brush seal 116 extends inward of the gas-turbine stator 112. In a first preferred construction, the brush seal 116 includes an attachment ring 152, and the attached end 148 is a part of the attachment ring 152 as shown in FIGS. 1 and 2. The brush seal 116 comprises a plurality of bristles 154 which preferably are tilted in the direction of rotation 156 of the gas-turbine rotor 114 as best shown in FIG. 2. The free end 150 of the brush seal 116 (i.e., the collective free ends of the bristles 154 of the brush seal 116) is disposed in general line-to-line contact with the first circumferential portion 138 of the outside surface 136 of the gas-turbine rotor 114 when the gas-turbine rotor 114 is in the first rotation/load state, and the predetermined differential radial and longitudinal thermal movement includes the free end 150 of the brush seal 116 (i.e., the collective free ends of the bristles 154 of the brush seal 116) moving radially inward and longitudinally across the second circumferential portion 140 of the outside surface 136 of the gas-turbine rotor 114, as is within the design capabilities of the artisan based on the teachings of the presently-described invention. By "line-to-line" contact is meant that the free end 150 of the brush seal 116 (i.e., the collective free ends of the bristles 154 of the brush seal 116) just touches the first circumferential portion 138 of the outside surface 136 of the gas-turbine rotor 114 without any bending of (or other interference with) the brush seal 116 (i.e., the bristles 154 of the brush seal 116).

Preferably, proximate the brush seal 116 during the transition (from the first rotation/load state to the second rotation/load state) the gas-turbine stator 112 undergoes thermal contraction faster than the gas-turbine rotor 114 undergoes thermal contraction. Preferably, the preferred groove form of the second circumferential portion 140 Of the outside surface 136 of the gas-turbine rotor 114 has a predetermined shape (as is within the design capabilities of the artisan based on the teachings of the presently-described invention) such that the free end 150 of the brush seal 116 (i.e., the collective free ends of the bristles 154 of the brush seal 116) does not contact the second circumferential portion 140 of the outside surface 136 of the gas-turbine rotor 114 during the transition (from the first rotation/load state to the second rotation/load state). The full-cycle predetermined differential radial and longitudinal thermal movement of the free end 150 of the brush seal 116 (i.e., the collective free ends of the bristles 154 of the brush seal 116) is shown as a dotted path 158 in FIG. 1 with the dot labeled 160 representing the relative position of the free end 150 of the brush seal 116 (i.e., the collective free ends of the bristles 154 of the brush seal 116) when the gas-turbine rotor 114 is at the first rotation/load state and with the dot labeled 162 representing the position of the free end 150 of the brush seal 116 (i.e., the collective free ends of the bristles 154 of the brush seal 116) when the gas-turbine rotor 114 is at the Second rotation/load state. Movement would be along the radially inward segment of the path 158 from dot 160 to dot 162 during the transition from the first rotation/load state to the second rotation/load state, and movement would along the radially outward segment of the path 158 from dot 162 to dot 160 during a later return to the first rotation/load state from the second rotation/load state when completing a full-cycle which started at the first rotation/load state. It is noted that particular gas turbines may have three or more different steady-state rotation/load states.

Figure 3:
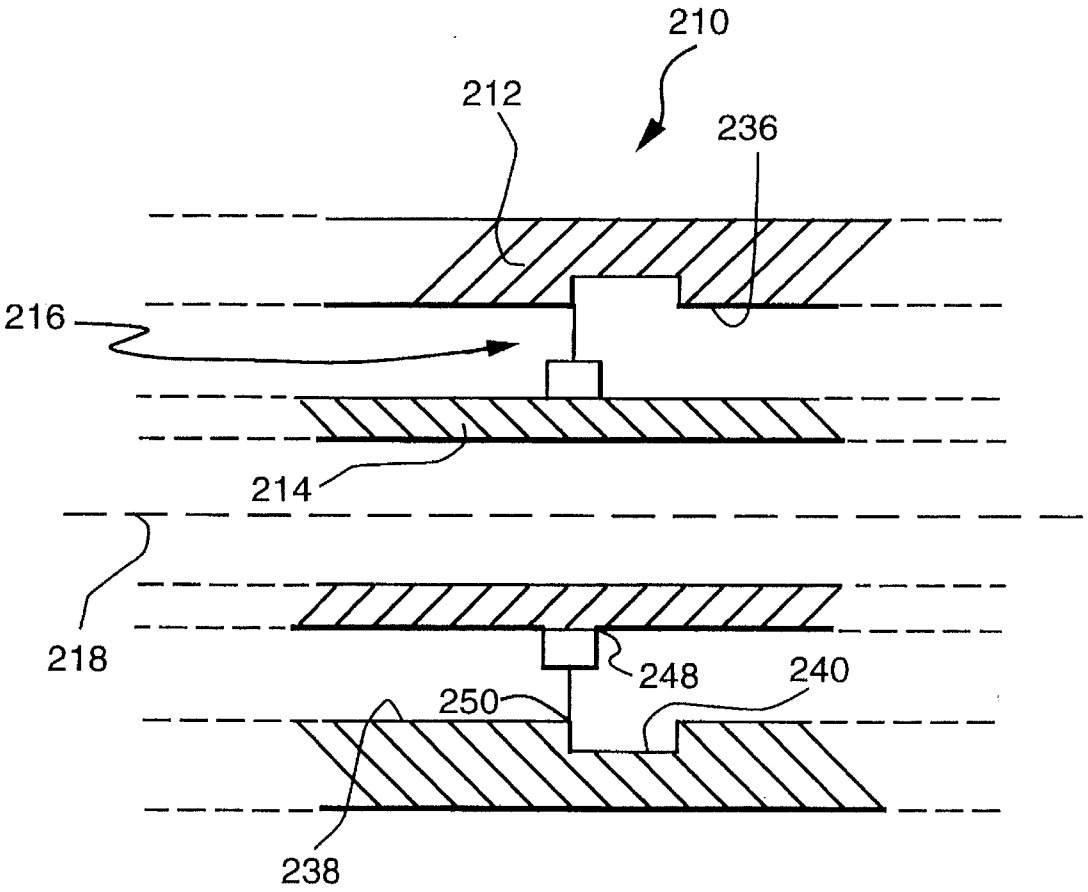
FIG. 3 is a schematic cross-sectional side-elevational smaller-area view of a second preferred embodiment of the gas-turbine subassembly of the present invention including a stator, a rotor, and a brush seal attached to the rotor.

A second preferred embodiment of the gas turbine subassembly 210 of the present invention is shown in FIG. 3. The gas turbine subassembly 210 includes a gas-turbine stator 212, a gas-turbine rotor 214, and a generally annular brush seal 216.

The gas-turbine stator 212 has a generally longitudinally extending axis 218 and an inside surface 236 with longitudinally-extending and longitudinally-adjoining first and second circumferential portions 238 and 240. The first circumferential portion 238 has a manufactured first diameter which is generally constant over the longitudinal extent of the first circumferential portion 238. The second circumferential portion 240 has a manufactured second diameter which is everywhere larger than the first diameter over the longitudinal extent of the second circumferential portion 240. Preferably, the second circumferential portion 240 has a form of a groove in the inside surface 236 of the gas-turbine stator 212.

The gas-turbine rotor 214 has generally-steady-state first and second rotation/load states. Preferably, the gas-turbine rotor 214 is a power-plant gas-turbine rotor, the first rotation/load state is a full-speed/full-load state, and the second rotation/load state is a turning-gear/no-load state. The gas-turbine rotor 214 and the gas-turbine stator 212 together undergo a predetermined differential radial and longitudinal thermal movement when the gas-turbine rotor 214 undergoes a transition from the first rotation/load state to the second rotation/load state.

The gas-turbine rotor 214 is generally coaxially aligned with and disposed radially within and radially apart from the gas-turbine stator 212.

The generally annular brush seal 216 is generally coaxially aligned with the gas-turbine rotor 214. The brush seal 216 has an attached end 248 and a free end 250. The attached end 248 of the brush seal 216 is attached (directly or indirectly) to the gas-turbine rotor 214, and the free end 250 of the brush seal 216 extends outward of the gas-turbine rotor 214. The free end 250 of the brush seal 216 is disposed in general line-to-line contact with the first circumferential portion 238 of the inside surface 236 of the gas-turbine stator 212 when the gas-turbine rotor 214 is in the first rotation/load state, and the predetermined differential radial and longitudinal thermal movement includes the free end 250 of the brush seal 216 moving radially outward and longitudinally across the second circumferential portion 240 of the inside surface 236 of the gas-turbine stator 212, as is within the design capabilities of the artisan based on the teachings of the presently-described invention.

Preferably, proximate the brush seal 216 during the transition (from the first rotation/load state to the second rotation/load state) the gas-turbine stator 212 undergoes thermal contraction faster than the gas-turbine rotor 214 undergoes thermal contraction. Preferably, the preferred groove form of the second circumferential portion 240 of the inside surface 236 of the gas-turbine stator 212 has a predetermined shape (as is within the design capabilities of the artisan based on the teachings of the presently-described invention) such that the free end 250 of the brush seal 216 does not contact the second circumferential portion 240 of the inside surface 236 of the gas-turbine stator 212 during the transition (from the first rotation/load state to the second rotation/load state).

Figure 4:
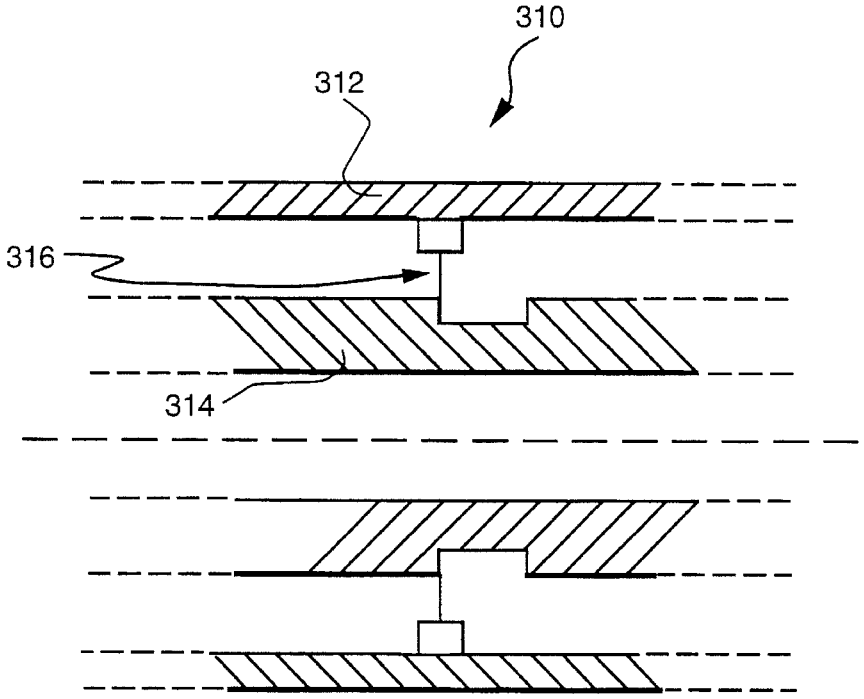
FIG. 4 is a schematic cross-sectional side-elevational smaller-area view of a third preferred embodiment of the gas-turbine subassembly of the present invention including a first rotor, a second rotor positioned within the first rotor, and a brush seal attached to the first rotor.

A third preferred embodiment of the gas turbine subassembly 310 of the present invention is shown in FIG. 4. The description of gas turbine subassembly 310 is identical to the previously-given description of gas turbine subassembly 110 of FIGS. 1 and 2 but with the term "gas-turbine stator 112" replaced with "first gas-turbine rotor 312" and with the term "gas-turbine rotor 114" replaced with "second gas-turbine rotor 314". Here, the generally annular brush seal 316 spans a gap between two gas-turbine rotors 312 and 314 and is attached to the first (outer) rotor 312.

Figure 5:
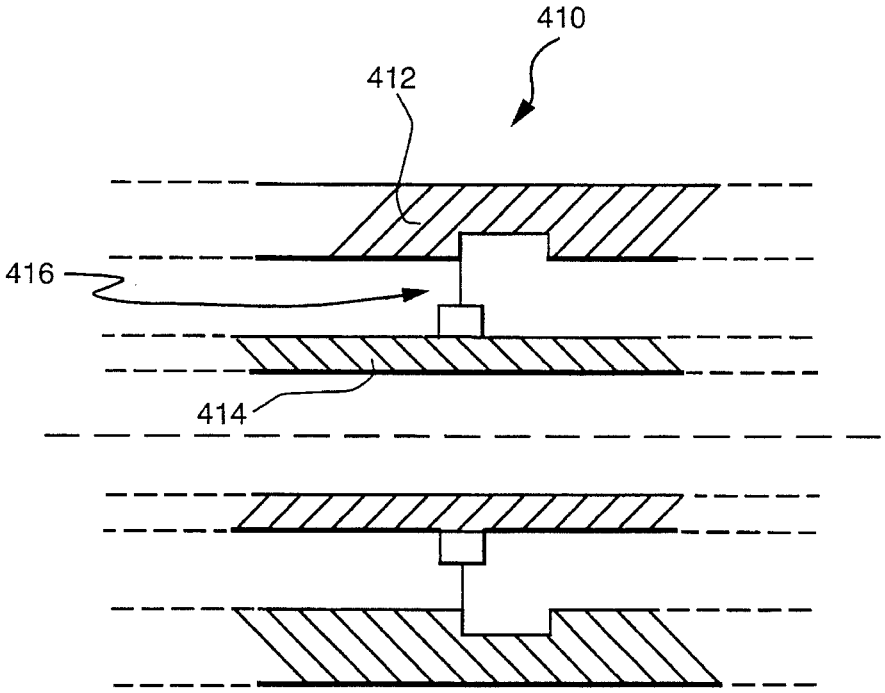
FIG. 5 is a schematic cross-sectional side-elevational smaller-area view of a fourth preferred embodiment of the gas-turbine subassembly of the present invention including a first rotor, a second rotor positioned within the first rotor, and a brush seal attached to the second rotor.

A fourth preferred embodiment of the gas turbine subassembly 410 of the present invention is shown in FIG. 5. The description of gas turbine subassembly 410 is identical to the previously-given description of gas turbine subassembly 210 of FIG. 3 but with the term "gas-turbine stator 112" replaced with "first gas-turbine rotor 412" and with the term "gas-turbine rotor 114" replaced with "second gas-turbine rotor 414". Here, the generally annular brush seal 416 spans a radial gap between two gas-turbine rotors 412 and 414 and is attached to the second (inner) rotor 414.

The foregoing description of several preferred embodiments of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

We claim:

1. A gas turbine subasSembly comprising:

a) a gas-turbine stator having a generally longitudinally extending axis;

b) a gas-turbine rotor having generally-steady-state first and second rotation/load statesi and generally coaxially aligned with and disposed radially within and radially apart from said gas-turbine stator, wherein said gas-turbine rotor includes an outside surface with longitudinally-extending and longitudinally-adjoining first and second circumferential portions, with said first circumferential portion having a manufactured first diameter which iis generally constant over the longitudinal extent of said first icircumferential portion, and with said second circumferential portion having a manufactured second diameter which is everywhere smaller than said first diameter over the longitudinal extent of said second circumferential portion, and wherein said gas-turbine rotor and said gas-turbine stator together undergo a predetermined differential radial and longitudinal thermal movement when said gas-turbine rotor undergoes a transition from said first rotation/load state to said second roation/load state; and c) a generally annular brush seal generally coaxially aligned with said gas-turbine stator, said brush seal having an attached end and a free end, with said attached end attached to said gas-turbine stator and with said free end extending inward of said gas-turbine stator, wherein said free end is disposed in general line-to-line contact with said first circumferential portion when said gas-turbine rotor is in said first rotation/load state, and wherein said predetermined differential radial and longitudinal thermal movement includes said free end moving radially inward and longitudinally across said second circumferential portion.

2. The gas turbine subassembly of claim 1, wherein said gas-turbine rotor is a power-plant gas-turbine rotor, wherein said first rotation/load state is a full-speed/full-load state and said second rotation/load state is a turning-gear/no-load state, and wherein proximate said brush seal during said transition said gas-turbine stator undergoes thermal contraction faster than said gas-turbine rotor undergoes thermal contraction.

3. The gas turbine subassembly of claim 2, wherein said second circumferential portion has a form of a groove in said outside surface of said gas-turbine rotor.

4. The gas turbine subassembly of claim 3, wherein said groove has a predetermined shape such that said free end of said brush seal does not contact said second circumferential portion during said transition.

5. A gas turbine subassembly comprising:

a) a gas-turbine stator having a generally longitudinally extending axis and an inside surface with longitudinally-extending and longitudinally-adjoining first and second circumferential portions, with said first circumferential portion having a manufactured first diameter which is generally constant over the longitudinal extent of said first circumferential portion, and with said second circumferential portion having a manufactured second diameter which is everywhere larger than said first diameter over the longitudinal extent of said second circumferential portion;

b) a gas-turbine rotor having generally-steady-state first and second rotation/load states and generally coaxially aligned with and disposed radially within and radially apart from said gas-turbine stator, wherein said gas-turbine rotor and said gas-turbine stator together undergo a predetermined differential radial and longitudinal thermal movement when said gas-turbine rotor undergoes a transition from said first rotation/load state to said second roation/load state; and c) a generally annular brush seal generally coaxially aligned with said gas-turbine rotor, said brush seal having an attached end and a free end, with said attached end attached to said gas-turbine rotor and with said free end extending outward of said gas-turbine rotor, wherein said free end is disposed in general line-to-line contact with said first circumferential portion when said gas-turbine rotor is in said first rotation/load state, and wherein said predetermined differential radial and longitudinal thermal movement includes said free end moving radially outward and longitudinally across said second circumferential portion.

6. The gas turbine subassembly of claim 5, wherein said gas-turbine rotor is a power-plant gas-turbine rotor, wherein said first rotation/load state is a full-speed/full-load state and said second rotation/load state is a turning-gear/no-load state, and wherein proximate said brush seal during said transition said gas-turbine stator undergoes thermal contraction faster than said gas-turbine rotor undergoes thermal contraction.

7. The gas turbine subassembly of claim 6, wherein said second circumferential portion has a form of a groove in said inside surface of said gas-turbine stator.

8. The gas turbine subassembly of claim 7, wherein said groove has a predetermined shape such that said free end of said brush seal does not contact said second circumferential portion during said transition.

9. A gas turbine subassembly comprising:

a) a first gas-turbine rotor having a generally longitudinally extending axis;

b) a second gas-turbine rotor having generally-steady-state first and second rotation/load states and generally coaxially aligned with and disposed radially within and radially apart from said first gas-turbine rotor, wherein said second gas-turbine rotor includes an outside surface with longitudinally-extending and longitudinally-adjoining first and second circumferential portions, with said first circumferential portion having a manufactured first diameter which is generally constant over the longitudinal extent of said first circumferential portion, and with said second circumferential portion having a manufactured second diameter which is everywhere smaller than said first diameter over the longitudinal extent of said second circumferential portion, and wherein said first and second gas-turbine rotors together undergo a predetermined differential radial and longitudinal thermal movement when said second gas-turbine rotor undergoes a transition from said first rotation/load state to said second rotation/load state; and c) a generally annular brush seal generally coaxially aligned with said first gas-turbine rotor, said brush seal having an attached end and a free end, with said attached end attached to said first gas-turbine rotor and with said free end extending inward of said first gas-turbine rotor, wherein said free end is disposed in general lineito-line contact with said first circumferential portion when said second gas-turbine rotor is in said first rotation/load state, and wherein said predetermined differential radial and longitudinal thermal movement includes said free end moving radially inward and longitudinally across said second circumferential portion.

10. A gas turbine subassembly comprising:

a) a first gas-turbine rotor having a generally longitudinally extending axis and an inside surface with longitudinally-extending and longitudinally-adjoining first and second circumferential portions, with said first circumferential portion having a manufactured first diameter which is generally constant over the longitudinal extent of said first circumferential portion, and with said second circumferential portion having a manufactured second diameter which is everywhere larger than said first diameter over the longitudinal extent of said second circumferential portion;

b) a second gas-turbine rotor having generally-steady-state first and second rotation/load states and generally coaxially aligned with and disposed radially within and radially apart from said first gas-turbine rotor, wherein said first and second gas-turbine rotors together undergo a predetermined differential radial and longitudinal thermal movement when said second gas-turbine rotor undergoes a transition from said first rotation/load state to said second rotation load state; and c) a generally annular brush seal generally coaxially aligned with said second gas-turbine rotor, said brush seal having an attached end and a free end, with said attached end attached to said second gas-turbine rotor and with said free end extending outward of said second gas-turbine rotor, wherein said free end is disposed in general line-to-line contact with said first circumferential portion when said second gas-turbine rotor is in said first rotation/load state, and wherein said predetermined differential radial and longitudinal thermal movement includes said free end moving radially outward and longitudinally across said second circumferential portion.

* * * * *